United States Patent [19]

Tea

[11] 4,121,515

[45] Oct. 24, 1978

[54] BALER FOR UNSHREDDED MATERIAL

[75] Inventor: Frank C. Tea, Bellevue, Ohio

[73] Assignee: The American Baler Company, Bellevue, Ohio

[21] Appl. No.: 846,901

[22] Filed: Oct. 31, 1977

[51] Int. Cl.[2] ..... B30B 15/08

[52] U.S. Cl. ..... 100/98 R; 100/189; 100/219; 100/232

[58] Field of Search ..... 100/98 R, 232, 191, 100/219, 179, 189, 42, 39

[56] References Cited

U.S. PATENT DOCUMENTS

| | | | |
|---|---|---|---|
| 253,719 | 2/1882 | Kirkpatrick | 100/232 |
| 2,355,645 | 8/1944 | Haase | 100/98 R |
| 3,030,876 | 4/1962 | Searles | 100/98 R |
| 3,576,161 | 4/1971 | Wright | 100/232 X |

FOREIGN PATENT DOCUMENTS

| | | | |
|---|---|---|---|
| 1,099,177 | 8/1955 | France | 100/232 |
| 671,596 | 5/1952 | United Kingdom | 100/98 R |
| 815,445 | 6/1959 | United Kingdom | 100/98 R |

*Primary Examiner*—Billy J. Wilhite

*Attorney, Agent, or Firm*—Bosworth, Sessions & McCoy

[57] ABSTRACT

Baling apparatus is disclosed which is capable of baling waste material which is not shredded prior to being fed into the baler. The apparatus includes an enlarged baling chamber with two reciprocal baling heads moving in perpendicular direction, each having a shearing blade fixed thereto which engage each other and a blade fixed to the side wall of the chamber to shear off material extending above the baling chamber.

16 Claims, 9 Drawing Figures

BALER FOR UNSHREDDED MATERIAL

BACKGROUND OF THE INVENTION

This invention relates to apparatus for compacting and forming bales of material in a continuous extrusion type baling machine.

Baling machines for baling waste paper and other industrial refuse known and are generally used for the purpose of forming the material into bales which can easily be handled while they are being transported to a place where the material is to be reprocessed. Such baling machines conventionally comprise a horizontal baling chamber having sides for constraining the bale laterally and an open outlet end of controllable cross section from which the bales are extruded, and a feed hopper inlet opening into the top side of the baling chamber for delivering material to the bale. A baling head reciprocates in the baling chamber past the inlet opening between a rearward position of retraction and an advanced position of extension. The baling head conventionally is driven by a hydraulic ram.

In operation, a charge of compressible material is dumped into the hopper and drops into the baling chamber while the baling head is retracted. Successive charges are compressed and compacted together in the baling chamber and against the resistance of the material previously compressed and being extruded through the throat by repeated strokes of the baling head. In this manner a length of compacted and compressed material is formed and extruded through and out the outlet open end of the baling chamber.

In the past, it has often been necessary to shred material to be baled prior to feeding the material into the hopper. Preshredding was necessary, particularly with large material, such as waste corrugated cardboard container, in order to properly fit the material into the baling chamber. Without shredding the material, the large pieces of material might extend through the top inlet opening to the baling chamber and bind the operation of the baling head as it compresses the material. Also, it would be very difficult to fill the chamber with a sufficiently full charge of unshredded material due to the small size of conventional baling chambers compared to the bulky low density nature of such material.

The shredding process of preparing the material to be baled requires an extra expensive procedure in the baling process. In addition, the shredding operation results in noise problems, fire hazards, and the discharge of dust, dirt and debris into the air.

SUMMARY OF THE INVENTION

The present invention provides an apparatus for baling waste material such as paper and corrugated cardboard without shredding the material prior to feeding the material into the apparatus, thereby overcoming the disadvantages of prior apparatus described above and providing an efficient manner of baling unshredded material while eliminating the costly and enviornmentally undesirable procedure of preshredding the material. The present invention also provides a baling apparatus with an enlarged baling chamber allowing the insertion of large pieces of material to be baled without precutting or otherwise preparing the material. The present invention is capable of operation essentially automatically without the requirement of an operator to constantly oversee normal operation of the machine.

These and other objects are accomplished by the baling apparatus of the present invention which includes a baling chamber into which loose unshredded material is delivered from a charging inlet. The baling chamber has a fixed side wall with shearing means fixed to the side wall adjacent to the inlet. The material is discharged from the baling chamber through an outlet at the end of the chamber. A first reciprocal baling head is adapted to move toward and away from the fixed sidewall between a retracted position for receiving loose material through the inlet and an advanced position spaced from the fixed sidewall. The first baling head has shearing means fixed to the head adjacent to the inlet. Means are provided for reciprocating the first baling head between its retracted and advanced position. A second reciprocal baling head is adapted to move in a direction generally perpendicular in a direction to movement of the first baling head between a retracted position for receiving loose material and an advanced position for compacting material and forcing the material through the outlet in the baling chamber. The second baling head has shearing means fixed to the head adjacent to the inlet. The shearing means on the second baling head are adapted to engage shearing means on the fixed sidewall on the baling chamber and the shearing means on the first baling head to shear off material extending from the baling chamber through the inlet. Means are also provided for reciprocating the second baling head. With both baling heads in their retracted positions, an enlarged baling chamber is provided for receiving large pieces of material to be baled.

Preferably, the shearing means fixed to the sidewall and the shearing means fixed to the first baling head extend diagonally and form a generally V-shaped configuration when the first baling head is in its advanced position so that the shearing means on the second baling head successively engages the other shearing means to gradually shear the material without resulting exceptionally high-level forces. The apparatus also preferably includes means for locking the first baling head in its advanced position as the second baling head is moved forward to compact the material and force it through the outlet.

DETAILED DESCRIPTION OF THE PREFERRED EMBODIMENT

Figure 1:
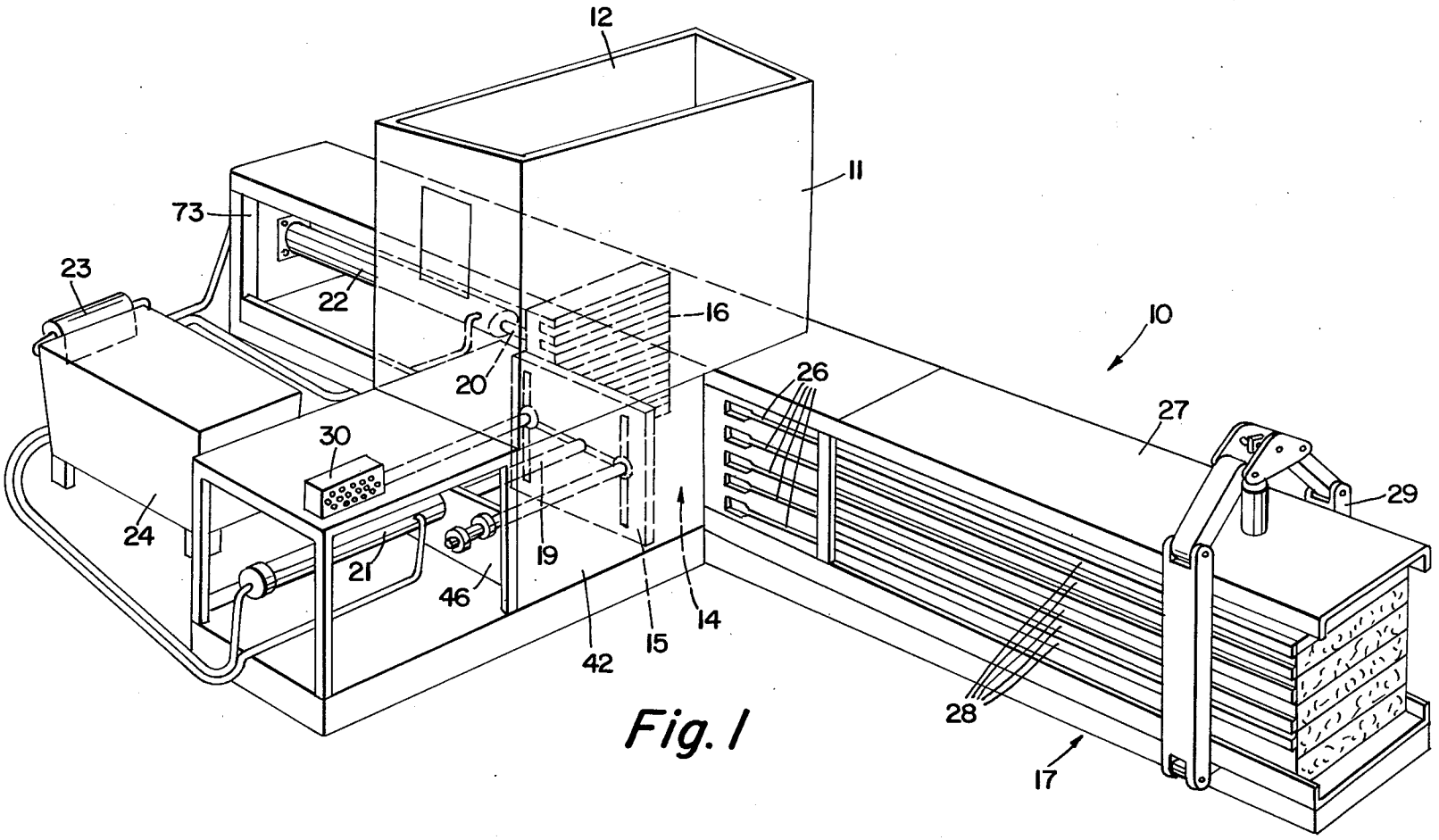
FIG. 1 is a perspective view of the baling apparatus of the present invention.

Referring more particularly to the drawings and initially to FIG. 1, there is generally shown a baling machine 10 which includes the apparatus of the present invention. The machine 10 includes a feed hopper 11 into which the material to be baled is fed through a top opening 12. The bale is formed in a baling chamber 14 directly below the hopper 11. The material is compressed in the baling chamber by reciprocating baling heads 15 and 16 and extruded through a throat portion 17 of controllable cross-sectional dimensions and out the forward end of the baler. The baling head 15 and 16 are reciprocated by ram means comprising piston rods 19 and 20 extending from hydraulic cylinders 21 and 22, respectively. The cylinders 21 and 22 are supplied from a pump 23 connected to a supply tank 24.

Each charge of material fed from the hopper 11 into the chamber 14 is compacted into a pad or wafer of compressed material. After a number of charges have been compressed together and a sufficient number of pads or wafers have accumulated to form the desired length for a full bale, a plurality of wires are inserted manually or automatically (by apparatus not shown in the drawings) through openings 26 in the side of the forward end of the baling chamber. After these wires have been tied, formation of another bale begins in the baling chamber 14 and the finished bale is forced through the throat portion 17 of the baling machine.

The throat portion 17 at the output end of the baling chamber 14 comprises a top wall 27 and a plurality of movable sidewall portions 28. The wall portions 27 and 28 are fixedly mounted near the baling chamber 14 while their opposite ends are able to be moved toward and away from each other and held at varying positions there-between so as to form a variably tapered construction for outlet passage having a minimum lateral dimension somewhat less than that of the baling chamber. Resistance to the movement of the bales in the throat portion 17 is provided by a conventional toggle-like constricting mechanism 20 which acts to position the free end of the movable sidewall portions 28. This resistance to the movement of the bales through the throat portion 17 allows the end of the last finished bale to provide a firm wall against which the material in the baling chamber is compacted by the baling head 16. The operation of the baling machine 10 can be controlled through a suitably connected control panel 30.

Figure 2:
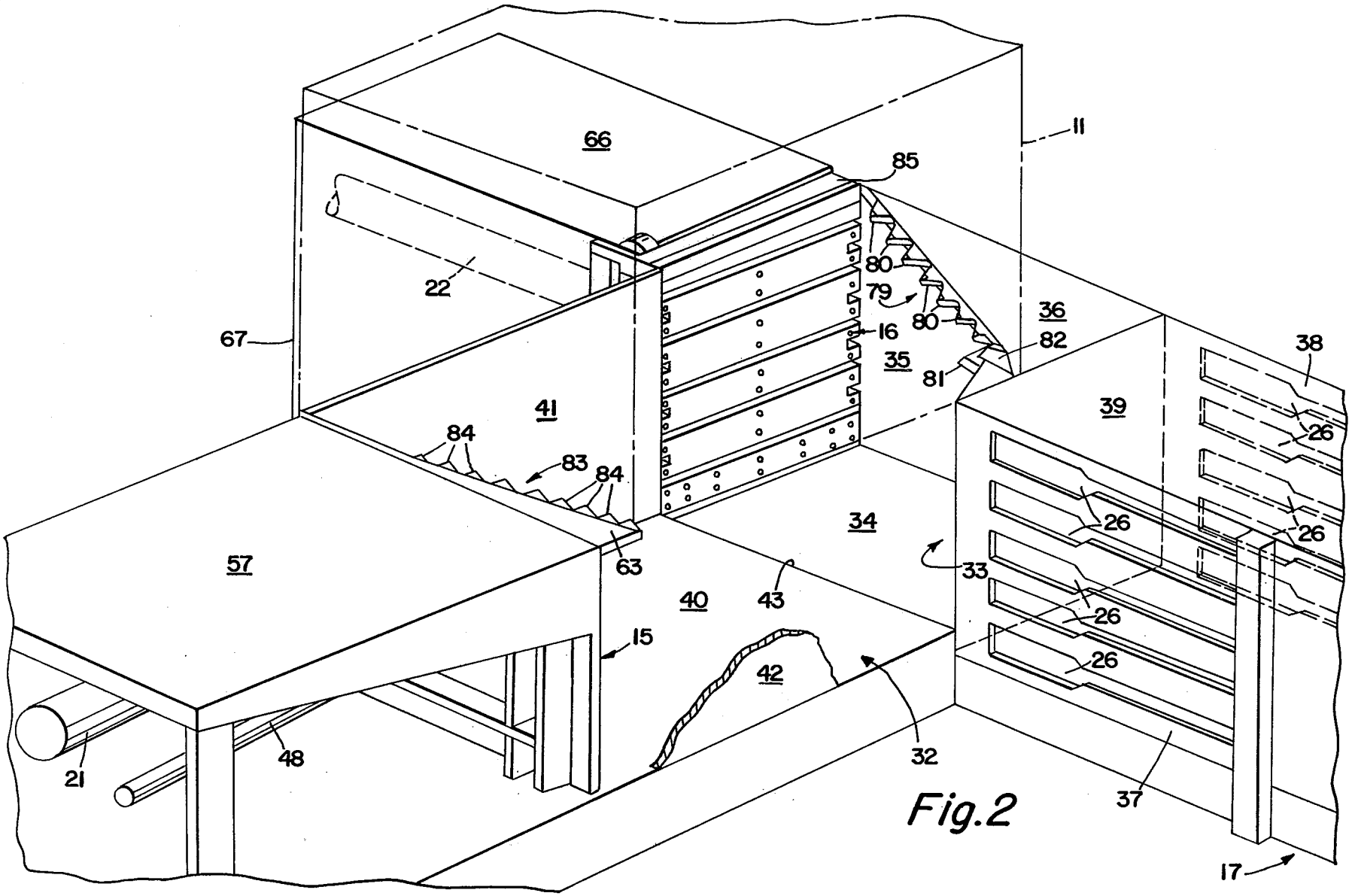
FIG. 2 is another perspective view to a larger scale of the baling chamber and baling heads of FIG. 1.

The baling chamber and the operation of the pair of baling heads is shown in greater detail in FIG. 2. The baling chamber 14 comprises an initial compression chamber 32 through which first baling head 15 travels, and a main compaction chamber 33 through which second baling head 16 travels. The main compaction chamber 33 comprises a horizontal floor 34 and a fixed upright vertical sidewall 35. A generally triangular horizontal top wall portion 36 extends from the top of the fixed sidewall 35 and covers a portion of the chamber 33. At the forward end of the main compaction chamber 33, the bale tying is accomplished through openings 26 in two parallel enclosing sides 37 and 38. A top wall 39 extends between enclosing sides 37 and 38 and covers the forward end of the chamber 33, connecting with top wall 27 of the throat portion 17. The initial compression chamber 32 extends laterally from the main compaction chamber 33 opposite fixed sidewall 35 and comprises a floor 40 and two parallel upright sidewalls 41 and 42. The level of floor 40 is raised slightly above the level of floor 34 forming a step 43. The first baling head 15 acts to initially compress the material in the baling chamber 14 in a direction generally traverse to the action of the second baling head 16. Thereafter, the second baling head 16 compacts the material toward the throat portion 17.

Figure 3:
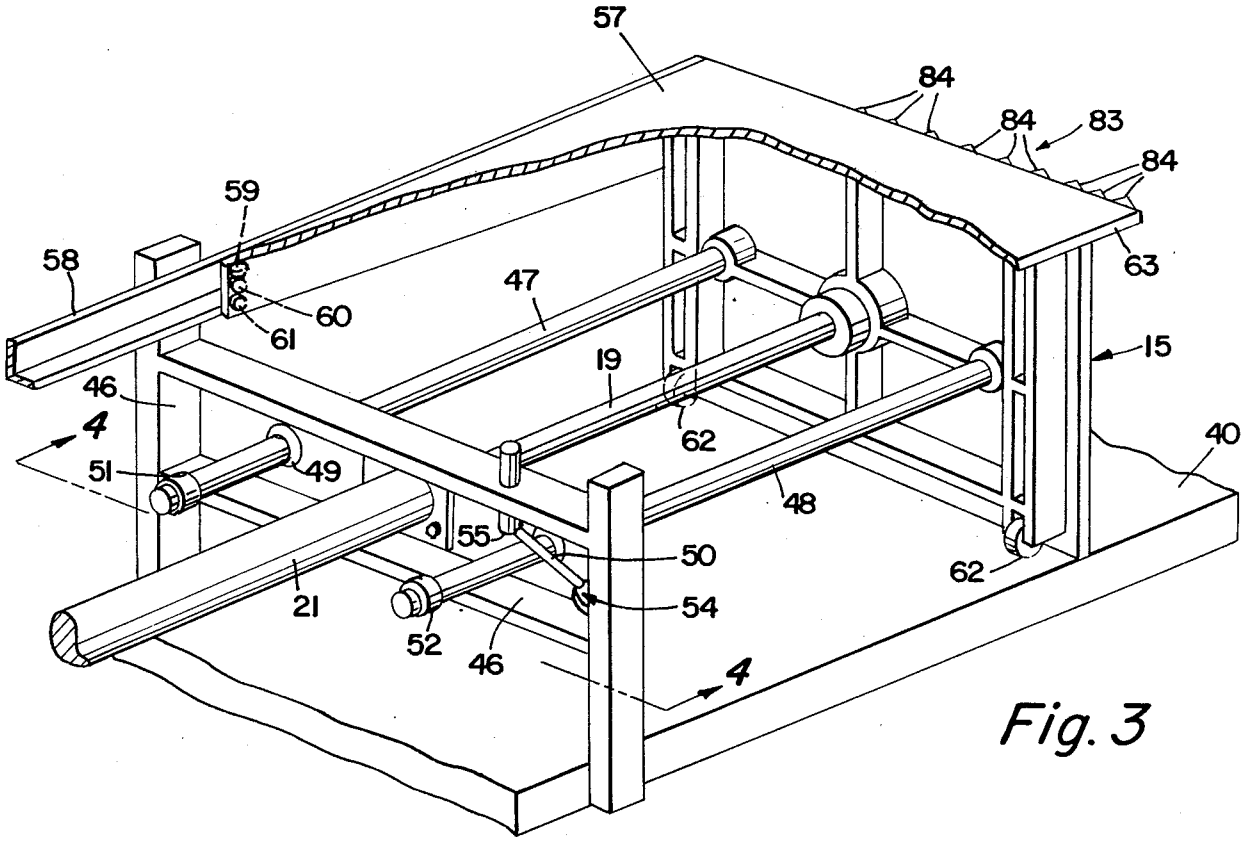
FIG. 3 is a perspective view from the same viewpoint to the same scale as FIG. 2, showing the first baling head.

The first baling head 15 is designed to accomplish the initial compression of the material and to move the material into the path of the second baling head 16 and subsequently to be fixed in its advanced position so that the second baling head 16 can accomplish the main high pressure compaction of the material through the outlet of the baling chamber and into the throat portion 17. As shown in FIG. 3, the first baling head 15 is reciprocated by connection to a piston rod 19 which extends from a hydraulic cylinder 21. The hydraulic cylinder 21 is mounted on an upstanding support 46 spaced behind the retracted position of the first baling head 15. To assure that the baling head 15 is properly aligned during its forward motion and is not forced out of alignment by the non-uniformity of the material being compacted in the baling chamber, a pair of alignment rods 47 and 48 are mounted to the baling head 15 on each side of the piston rod 19 and extend through openings 49 and 50 in the support 46. Forward motion of the baling head 15 is limited by adjustable collars 51 and 52 on the end of each of the alignment rods 47 and 48. As the baling head 15 is moved forward, the collars 51 and 52 engage the support around the openings 49 and 50, respectively, when the baling head 15 is in its precise forwardmost position with the front surface of the baling head aligned with sidewall 37 and the step 43 at the end of the floor 40, and thereby prevents further forward movement of the baling head. Preferably, each of the collars 51 and 52 is longitudinally adjustable on its respective rod 47 and 48, so that the precise forward position of the baling head 15 can be adjusted as necessary due to wear.

Figure 4:
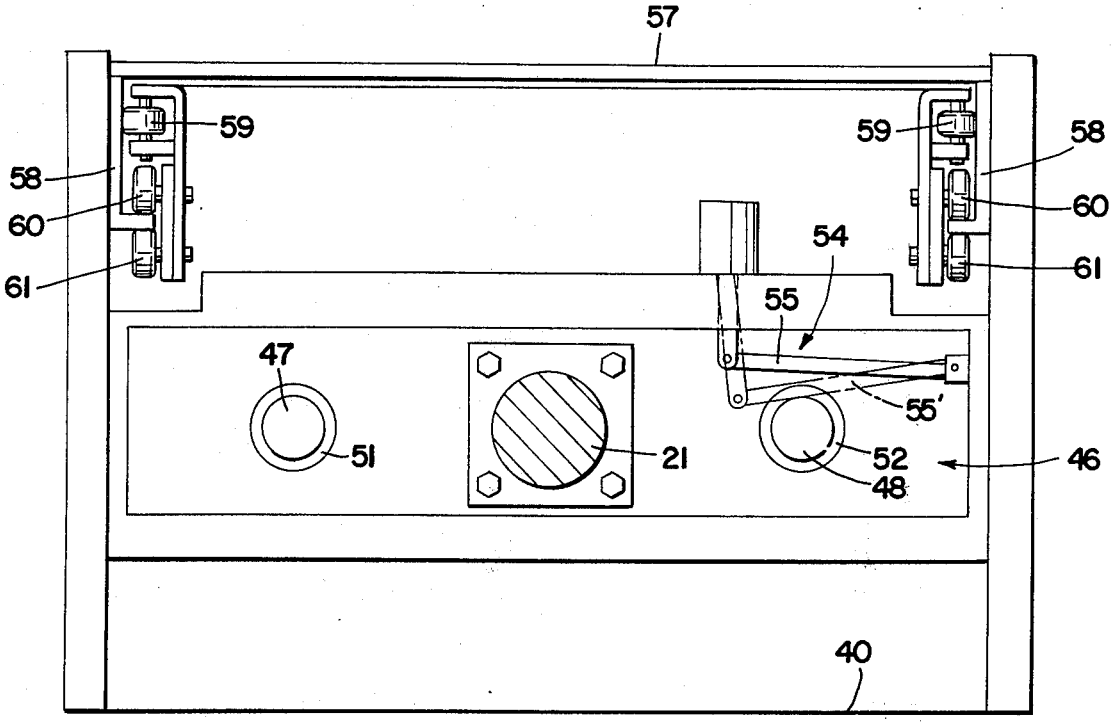
FIG. 4 is an end elevational view taken along line 4—4 of FIG. 3.

The baling head 15 is locked in its forwardmost position by a hydraulically actuated locking means 54 which includes a lever 55 which drops down over the rearward path of the alignment rod 48, as shown in broken lines 55' in FIG. 4, thereby preventing retraction of the rod 48 and the attached baling head 15 from the forces in the baling chamber resulting from the compaction of the material by the second baling head 16. A similar locking means can also be provided on the end of the other alignment rod 47; however, it has been found that the locking means is only necessary on the alignment rod on the outlet side of the baling chamber since this side of the first baling head 15 is subjected to the greatest forces during the main compaction operation of the second baling head 16.

To prevent material from dropping into the baling chamber behind the first baling head 15 as the baling head is advanced, the top of the baling chamber is closed by a horizontal plate 57 (FIG. 2) which is mounted to the top of the baling head 15 and extends rearwardly over the piston rod 19 and the alignment rods 47 and 48. The rearward end of the closure plate 57 is supported on rails 58 (FIG. 3) by a plurality of rollers 59, 60, and 61 (FIG. 4). The vertically mounted rollers 59 on each side of the closure plate 57 engage the inward vertical surfaces of the rails 58, while the horizontally mounted rollers 60 and 61 engage the top and the bottom, respectively, of the horizontal portion of the rails 58. The rails 58 extend along each side of the closure plate 57 between the support 46 and the sidewalls 41 and 42. Rollers 62 (FIG. 3) are also provided on the bottom of the baling head 15 to assist in movement of the head during reciprocation. The front surface of the first baling head 15 also has a ledge 63 at the top thereof which projects into the baling chamber. The ledge 63 is angled such that the side of the ledge nearer to the outlet of the chamber extends further outwardly.

Figure 5:
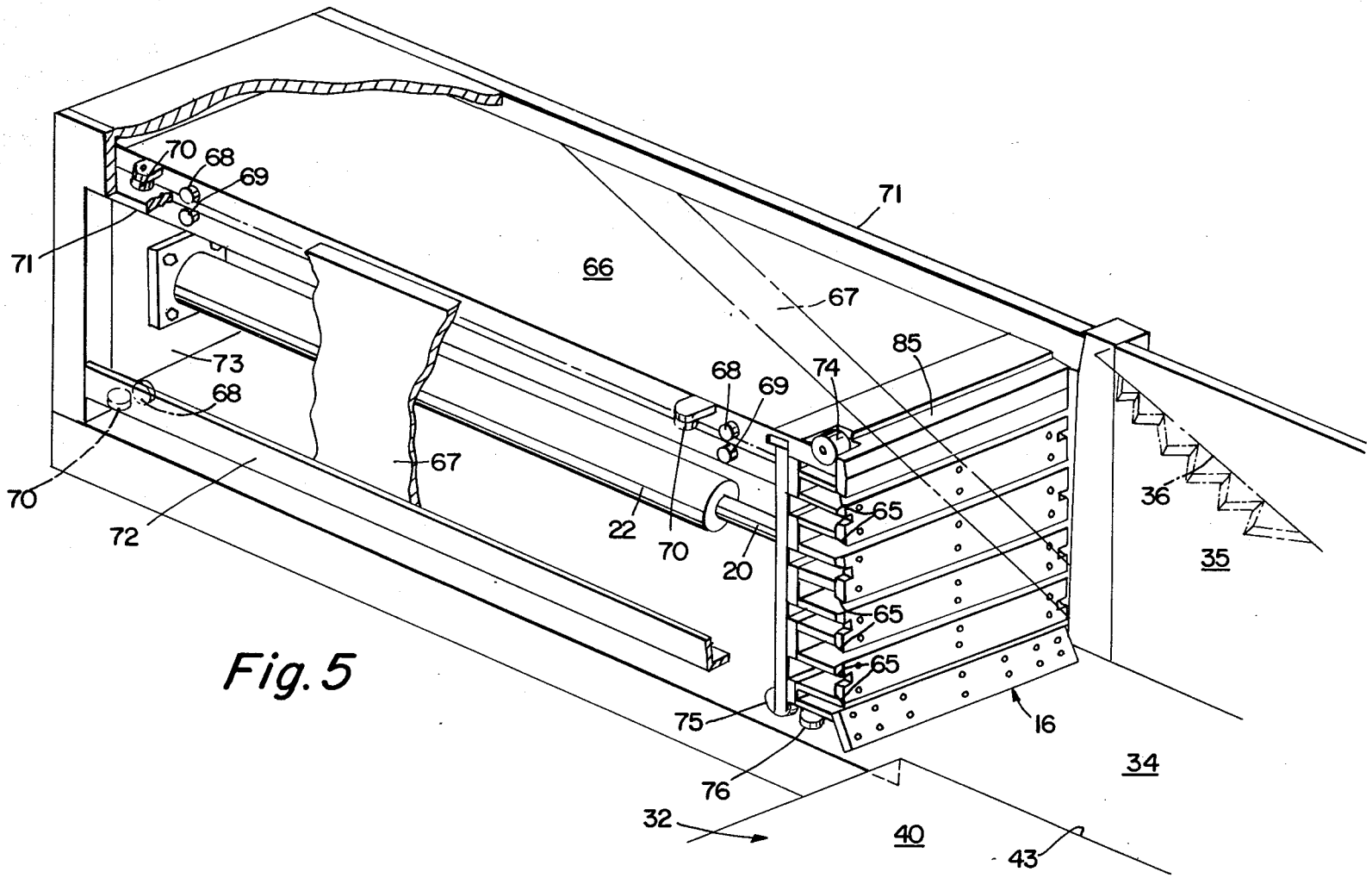
FIG. 5 is a perspective view of the same viewpoint and to the same scale as FIG. 2, showing the second baling head.
Figure 6:
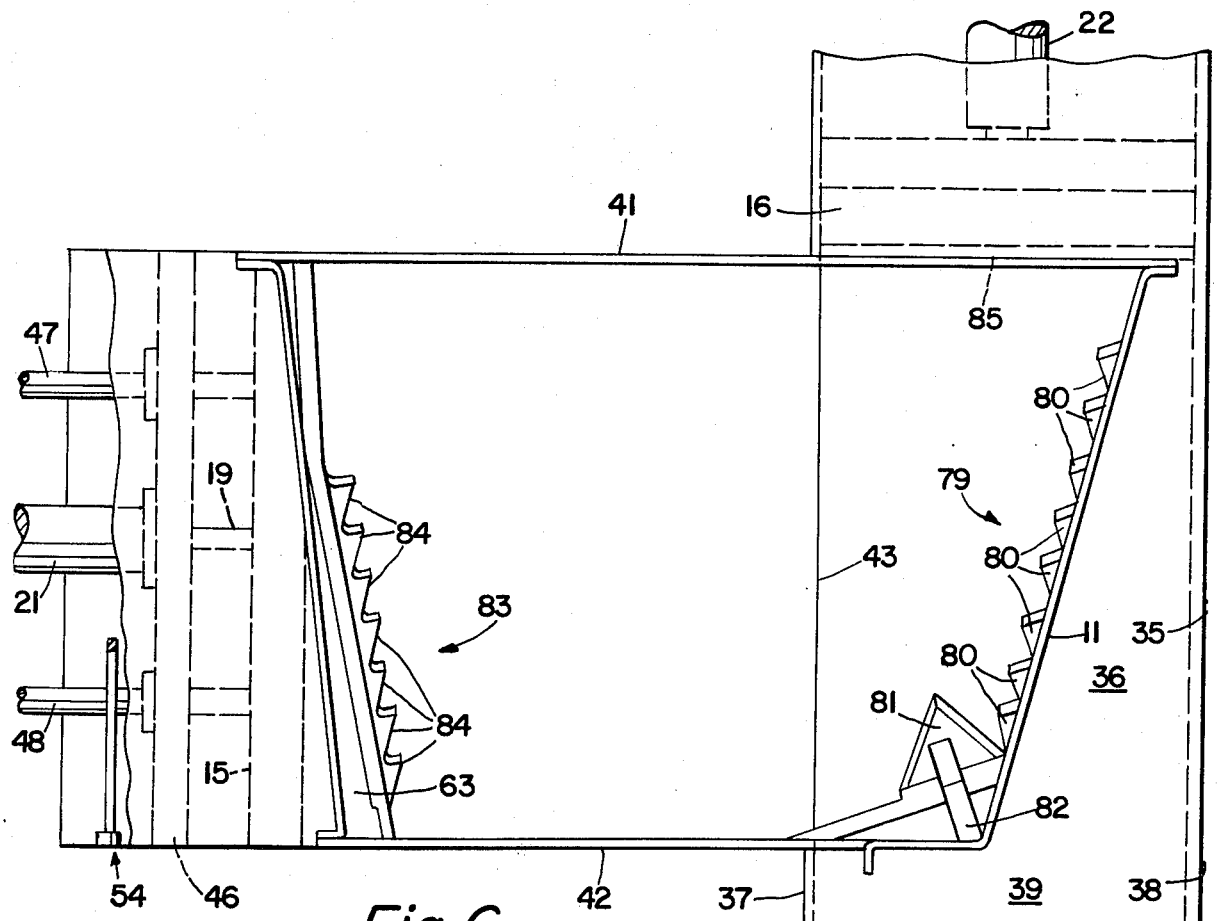
FIGS. 6 through 9 are successive top plan views showing the baling chamber and the movement of the baling heads and shearing means during steps in the operation of the apparatus.

After the first baling head 15 is advanced to its forward position to initially compress the material in the chamber and after the first baling head 15 is locked into place by the locking means 54, the main high-pressure compaction is performed by the second baling head 16. The second baling head 16 is reciprocal between a retracted position in which the front surface of the baling head is essentially flush with the side wall 41 and an advanced position in which the baling head 16 is adjacent to the openings 26 in the enclosing sides 37 and 38. In accordance with known design, the second baling head 16 has a plurality of transverse slots 65 (FIG. 5) for the insertion of the tying wires. Each of the slots 65 extends into the baling head 16 from the front surface of the head. When the baling head 16 is in its forwardmost position, the slots 65 are aligned with the openings 26 in the enclosing sides 37 and 38 and provide passages for the insertion of the wires used for tying the finished bale.

The second baling head 16 also has a horizontal closure plate 66 mounted to the top thereof and extending rearwardly over the piston rod to close the baling chamber and to prevent material from entering the chamber behind the baling head 16 as the baling head is advanced. A vertical closure plate 67 extends rearwardly from the side of the second baling head 16 closest to the first baling head 15 and extends downwardly from horizontal closure plate 66. The vertical closure plate 67 prevents material dropping into the initial chamber 32 from falling behind the second baling head 16 when both baling heads are retracted. Preferably, both baling heads are retracted simultaneously, and as the first baling head 15 retracts, allowing material to fall onto the floor 40, some material would also fall behind the partially retracted baling head 16 without the presence of the closure plate 67.

On the opposite side opposite the vertical closure plate 67, the horizontal closure plate 66 is supported by a diagonal brace 68 which extends between the bottom of the baling head 16 and the rear of the plate. The closure plates 66 and 67 are also supported and maintained in alignment by a plurality of rollers 68, 69 and 70 which engage the top, bottom and sides, respectively, of horizontal rails 71 and 72 which extend along each side. The rearward ends of the rails 71 and 72 are supported by a rear frame 73 which also serves to support the end of the hydraulic cylinder 22. The forward ends of the rails 71 and 72 are supported by connection to the sidewalls 35 and 41. The support and alignment of the baling head 16 is assisted by a plurality of rollers 74, 75 and 76 mounted to the head. Upper horizontally mounted roller 74 engages the bottom of the ledge 63 on the first baling head 15. Lower horizontally mounted rollers 75 on the bottom of the baling head roll along the surface of the floor 34. Lower vertically mounted rollers 76 on the sides of the baling head engage the vertical surface of the step 43 and the lower inner surface of the fixed sidewall 35.

As large pieces of material are fed through the hopper 12 into the baling chamber 10 some of the pieces will extend beyond the top of the baling chamber 14 and into the feed hopper 11. The ability to cut these large upwardly extending pieces permits the baling of large pieces of material which have not previously been shredded without clogging the baling mechanism. This cutting action is provided by shearing means mounted to the fixed portion of the baling chamber and to each of the baling heads. A fixed shearing means 79 is mounted on the diagonally extending edge of the top wall portion 36 extending from the fixed sidewall 35. The shearing means 79 comprises a row of sharp sawteeth 80 which terminate in a larger tooth 81 which points generally toward the retracted position of the second baling head 16. The larger tooth 81 is supported on the top wall portion by a brace 82. The movable shearing means 83 is mounted on the top of the first baling head 15 along the angled edge of the forwardly extending ledge 63. The shearing means 83 comprises a similar row of diagonally mounted sharp sawteeth 84. When the first baling head 15 is in its forwardmost position, the shearing means 79 and 83 combine to form a generally V-shaped opening in the top of the chamber lined by cutting teeth 80 and 84 with the larger tooth 81 at the point of the V-shaped opening. The teeth 80 and 84 are engaged to shear the material projecting through the opening in the top of the chamber by a shearing means on the second baling head 16 comprising a cutting blade 85 mounted on top of the front compacting surface of the baling head 16. As the second baling head 16 is moved forward, the blade 85 on the top of the head successively engages the teeth 80 and 84 of the shearing means 79 and 83 to cut any material extending upwardly through the opening in the top of the baling chamber 14.

The shearing or cutting operation is performed without encountering large resistive forces by means of the diagonal orientation of the shearing means 79 and 83. Since the shearing means 79 and 83 are diagonally mounted forming a V-shaped configuration, the cutting blade 85 successively engages only a portion of the shearing means 79 and 83 as the blade 85 is advanced. The shearing operation thus occurs gradually over a substantial portion of the movement of the baling head 16. Substantial shearing forces which would result if the cutting operation were to occur only at the end of the forward stroke of the baling head 16 are avoided.

The operation of the baling head to compact large pieces of material and to shear off unnecessary material can be understood with reference to FIGS. 6–9. With both baling heads 15 and 16 in their retracted positions (FIG. 6), each of the closure plates 57 and 66 is retracted and material in the hopper 11 is free to fall through the inlet in the top of the baling chamber 14 into the chamber, so that the chamber is filled with material thereby. The retracted position of the first baling head 15 can be adjusted to allow for the desired amount of material to enter the baling chamber 14. For example, with material relatively of low density such as corrugated cardboard, it would be desirable to have the baling head 15 in its rearwardmost position to allow the greatest possible amount of material to enter the enlarged baling chamber 14. However, with material of a substantially greater density such as newsprint, it may be desirable to position the first baling head 15 nearer to its forwardmost position to reduce the size of the open baling chamber 14 and thereby reduce the amount of material which will enter the baling chamber from the feed hopper 11 in order to obtain in a compacted charge of the proper size and density.

Figure 7:
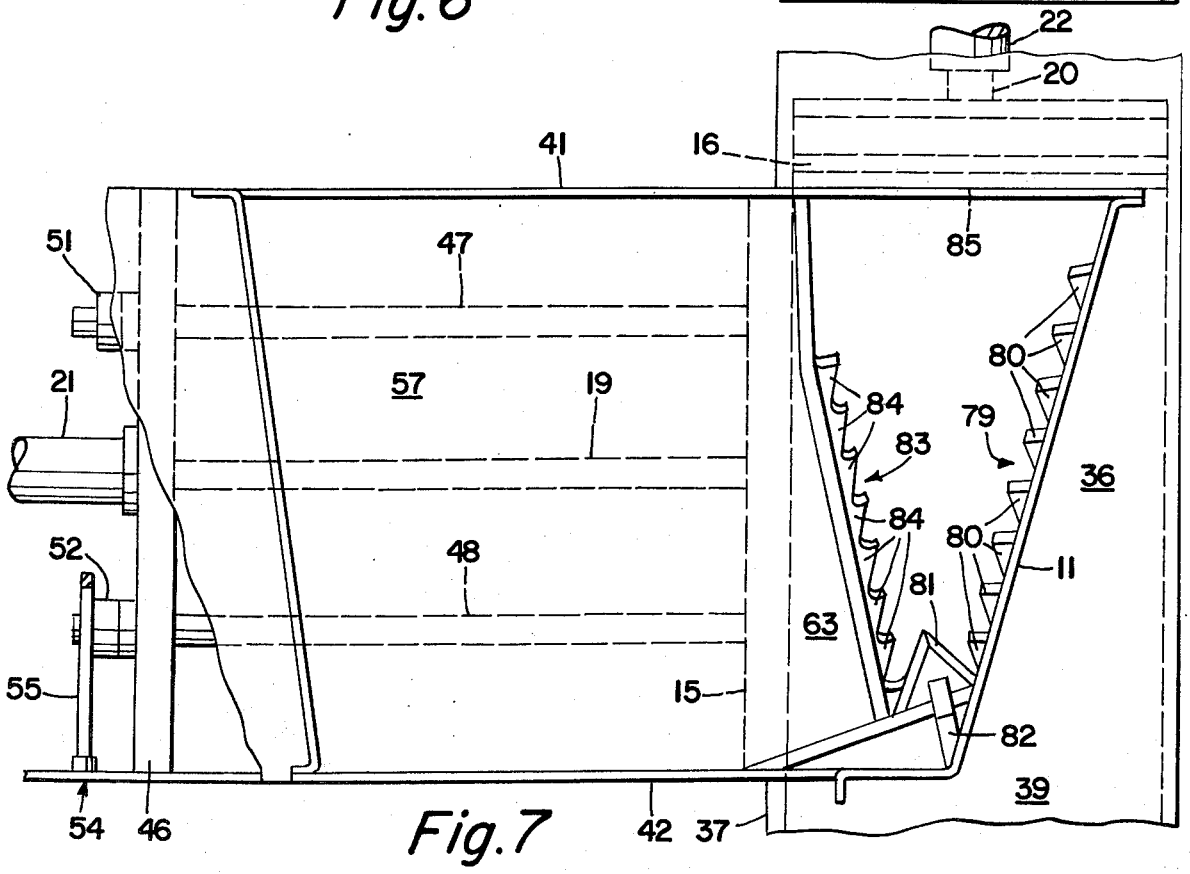
Figure 8:
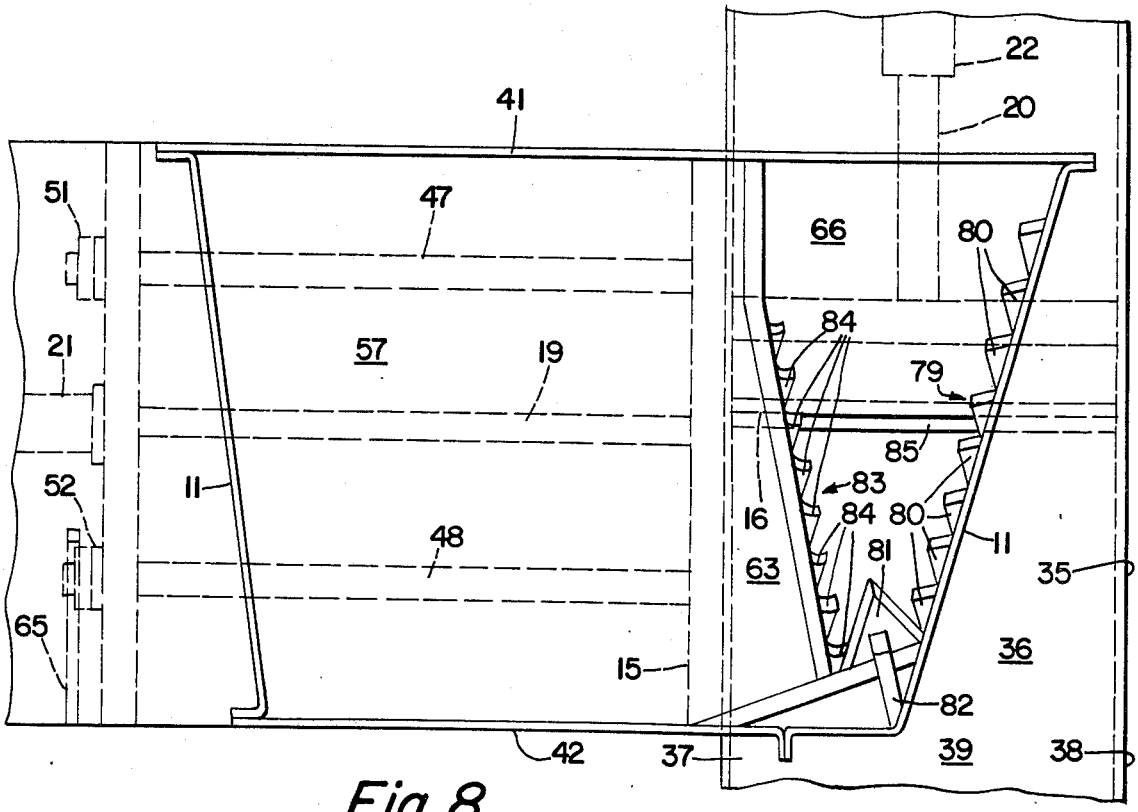
Figure 9:
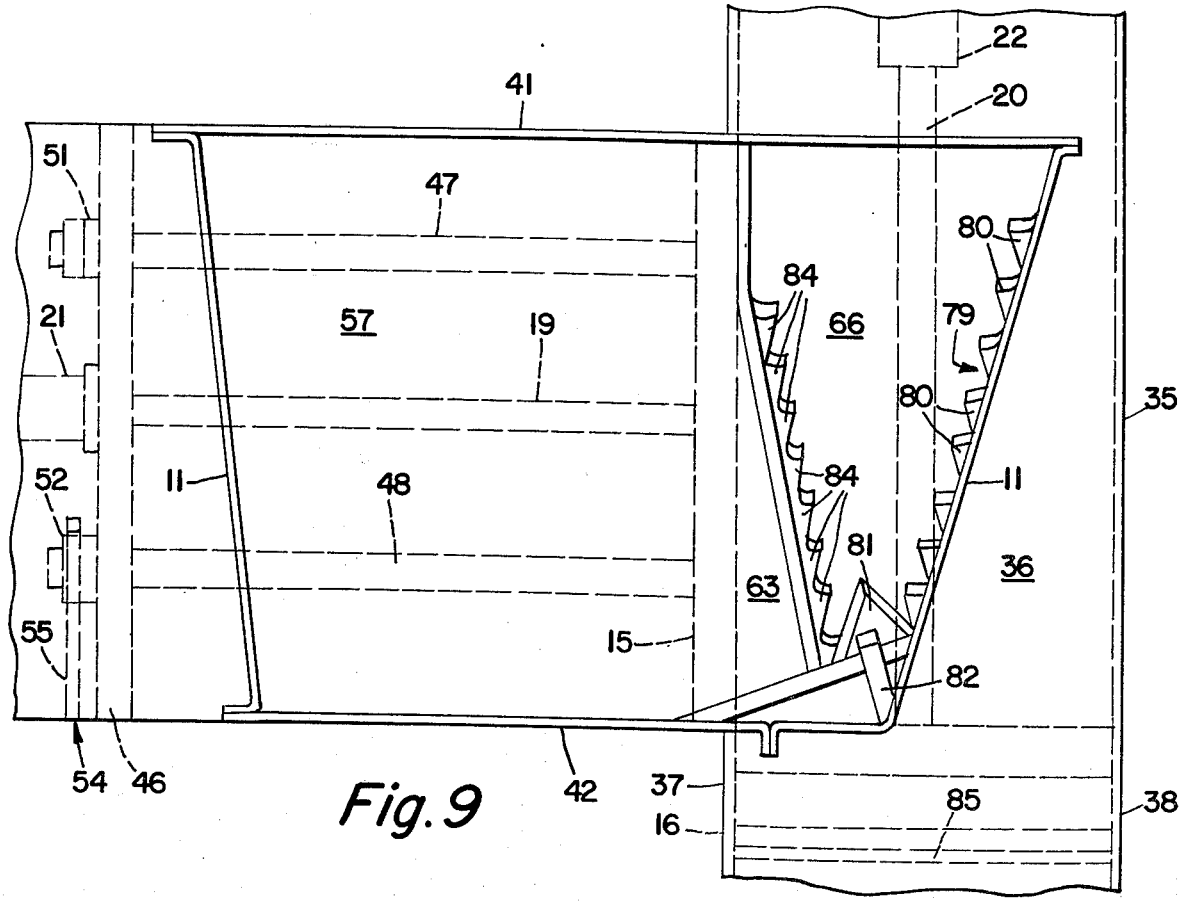

After the baling chamber 14 has been filled with the material to be baled from the hopper 11, the hydraulic cylinder 21 is actuated and the first baling head 15 is moved forward until the collars 51 and 52 on the alignment rods 47 and 48 contact the portions of the support 46 surrounding the openings 49 and 50 whereby the baling head 15 is in its forwardmost position with the front surface of the baling head 15 aligned with the step 43 and with the forward enclosing side 37 (FIG. 7). The hydraulic locking means 54 is then actuated, and the first baling head 15 is locked in its forwardmost position with the shearing means 83 mounted on the upper forward end of the baling head 15 positioned opposite the fixed shearing means 79 on the top wall portion 36 in a generally V-shaped configuration.

Thereafter, the hydraulic cylinder 22 advances the second baling head 16 from its retracted position in which the front surface of the baling head is flush with the sidewall 41 to its forwardmost position wherein the slots 65 in the baling head 16 are aligned with the openings 26 in the enclosing 37 and 38 sides. As the baling head advances to its forwardmost position (FIG. 8), the cutting blade 85 on top of the baling head 16 engages the teeth 80 and 84 of the shearing means 79 and 83 to shear off any large pieces of material which extend beyond the top of the baling chamber.

The charge of material in the baling chamber is then compressed into a pad or wafer of compressed material against the end surface of the last finished bale in the throat portion 17. The second baling head 16 is then retracted after which the first baling head 15 is retracted, and the baling chamber is filled with a new charge of material to be baled from the hopper 11. After a number of charges have been compressed together and a sufficient number of pads or wafers have accumulated to form the desired length for a full bale, the second baling head 16 is maintained in its fully advanced and typing position (FIG. 9), and a plurality of wires is inserted through the openings 26 in the side enclosing 37 of the baling chamber and through the corresponding transverse slots 65 in the baling head. After these wires have been tied, formation of another bale begins.

It will be obvious to those skilled in the art to which this invention pertains that various modifictions and changes of the preferred embodiment described and show herein may be made without departing from the spirit and scope of this invention.

What is claimed is:

1. Apparatus for baling unshredded material comprising:

a charging inlet for receiving loose material;

a baling chamber into which material is delivered from said inlet, said chamber having a fixed sidewall with shearing means attached to said sidewall adjacent to said inlet;

a discharge outlet from said baling chamber;

a first reciprocal baling head adapted to move toward and away from said fixed sidewall between a retracted position for receiving loose material through said inlet and an advanced position spaced from said fixed sidewall, said first baling head having shearing means attached thereto adjacent to said inlet;

means for reciprocating said first baling head;

a second reciprocal baling head adapted to move in a direction generally perpendicular to the direction of movement of said first baling head between a retracted position for receiving loose material and an advanced position for compacting material into said outlet, said second baling head having shearing means mounted thereon adjacent to said inlet, said shearing means on said second baling head adapted to engage the shearing means on said fixed sidewall and on said first baling head to shear off material extending from said chamber through said inlet; and means for reciprocating said second baling head.

2. Apparatus as in claim 1 wherein the shearing means on said fixed sidewall and the shearing means on said first baling head extend diagonally with respect to the direction of movement of said second baling head.

3. Apparatus as in claim 2 wherein the shearing means on said fixed sidewall and the shearing means on said first baling head form a generally V-shaped configuration when said first baling head is in its advanced position.

4. Apparatys as in claim 1 comprising in addition means for locking said first baling head in its advanced position while said second baling head is moved from it retracted position to its advanced position.

5. Apparatus as in claim 1 comprising in addition hopper means for storing material to be baled and for feeding material into the baling chamber through said charging inlet.

6. Apparatus for baling unshredded material comprising:

a charging inlet for receiving loose material;

a baling chamber into which material is delivered from said inlet, said chamber having a fixed sidewall with a diagonally extending shearing means attached to said sidewall adjacent to said inlet;

a discharge outlet from said baling chamber;

a first reciprocal baling head adapted to move toward and away from said fixed sidewall between a retracted position for receiving loose material through said inlet and an advanced position spaced from said fixed sidewall, said first baling head having a diagonally extending shearing means attached thereto adjacent to said inlet, the shearing means on said first baling head and the shearing means on said fixed sidewall forming a generally V-shaped configuration when said first baling head is in its advanced position;

means for reciprocating said first baling head;

means for locking said first baling head in its advanced position;

a second reciprocal baling head adapted to move in a direction generally perpendicular to the direction of movement of said first baling head when said first baling head is locked in its advanced position, said second baling head reciprocal between a retracted position for receiving loose material and an advanced position for compacting material into said outlet, said second bailing head having shearing means mounted thereon adjacent to said inlet, said shearing means on said second baling head adapted to engage the V-shaped shearing means on said sidewall and on said first baling head when said first baling head is locked in its advanced position to shear off material extending from said chamber through said inlet; and means for reciprocating said second baling head.

7. Apparatus as in claim 6 wherein the shearing means on said first baling head and the shearing means on said fixed sidewall each comprises a plurality of sharp sawteeth.

8. Apparatus as in claim 7 wherein the shearing means on said fixed sidewall also comprises an enlarge tooth projecting toward the retracted position of said second bailing head at the point of said V-shaped configuration.

9. Apparatus as in claim 6 wherein said means for reciprocating said first baling head and said means for reciprocating said second baling head each comprises a hydraulic cylinder with a piston rod extending from said cylinder attached to the baling head.

10. Apparatus as in claim 9 wherein said hydraulic cylinder for receiprocating said second baling head is capable of substantially higher pressure than the hydraulic cylinder for reciprocating said first baling head.

11. Apparatus as in claim 6 comprising in addition a pair of alignment rods extending from said first baling head, and a fixed support having openings through which said alignment rods extend to maintain said first baling head in proper alignment as it is moved from its retracted position to its advanced position.

12. Apparatus as in claim 11 wherein said alignment rods have attached stop means which engage said fixed support to prevent further forward movement of said first baling head when it is in its advanced position.

13. Apparatus as in claim 12 wherein said stop means are collars mounted on said alignment rods, each collar longitudinally adjustable along its alignment rod.

14. Apparatus as in claim 11 wherein said means for locking said first baling head is mounted on said fixed support to lock the rearward movement of one of said alignment rods.

15. Apparatus as in claim 6 wherein the retracted position of said first baling head is adjustable to vary the size of said baling chamber to allow the proper amount of material to be delivered into said chamber from said inlet.

16. Apparatus for baling unshredded material comprising:

a hopper for temporarily storing loose material to be baled;

a baling chamber below said hopper having an inlet through which material is delivered downwardly from said hopper, said chamber having a fixed vertical sidewall with shearing means mounted to the top of said sidewall;

a discharge outlet from said baling chamber;

a first reciprocal baling head adapted to move horizontally toward and away from said fixed vertical sidewall between a retracted position for receiving loose material from said hopper and an advanced position horizontally spaced from said fixed sidewall, said first baling head having a diagonally extending shearing means mounted to the top thereof, the shearing means on said first baling head and the shearing means on said fixed sidewall forming a generally V-shaped configuration when said first baling head is in its advanced position;

a first hyraulic cylinder for reciprocating said first baling head;

a pair of alignment rods extending from said first baling head;

a fixed support having an opening through which said alignment rods extend to maintain said first baling head in proper alignment as it is moved from its retracted position to its advanced position;

means on said fixed support for locking said first baling head in its advanced position by engaging one of said alignment rods;

a second reciprocal baling head adapted to move horizontally in direction generally perpendicular to the direction of movement of said first baling head when said first baling head is locked in its advanced position, said second baling head reciprocal between a retracted position for receiving loose material and an advanced position for compacting material into said outlet, said second baling head having shearing means fixed to the top thereof adapted to engage the V-shaped shearing means on the top of said fixed sidewall and on said first baling head to shear off material extending from said chamber through said inlet; and a second hydraulic cylinder for reciprocating said second baling head, said second hydraulic cylinder capable of substantially greater pressure than said first cylinder.

* * * * *